US010251500B2

(12) United States Patent
Marcu

(10) Patent No.: US 10,251,500 B2
(45) Date of Patent: Apr. 9, 2019

(54) RETAINING BLOCK FOR A CUTLERY-HOLDER SYSTEM FOR ONE OR MORE ITEMS OF CUTLERY, AND CUTLERY-HOLDER SYSTEM HAVING AT LEAST TWO RETAINING BLOCKS

(71) Applicant: FRIEDRICH UG (HAFTUNGSBESCHRÄNKT), Ludwigsburg (DE)

(72) Inventor: Klaus Marcu, Ludwigsburg (DE)

(73) Assignee: FRIEDRICH UG (HAFTUNGSBESCHRÄNKT), Ludwigsburg (DE)

( * ) Notice: Subject to any disclaimer, the term of this patent is extended or adjusted under 35 U.S.C. 154(b) by 0 days.

(21) Appl. No.: 15/574,909

(22) PCT Filed: Jun. 1, 2016

(86) PCT No.: PCT/EP2016/062403
§ 371 (c)(1),
(2) Date: Dec. 1, 2017

(87) PCT Pub. No.: WO2016/193317
PCT Pub. Date: Dec. 8, 2016

(65) Prior Publication Data

US 2018/0160830 A1 Jun. 14, 2018

(30) Foreign Application Priority Data

Jun. 2, 2015 (DE) ..... 10 2015 108 734

(51) Int. Cl.
*A47G 21/14* (2006.01)

(52) U.S. Cl.
CPC ..... *A47G 21/14* (2013.01)

(58) Field of Classification Search
CPC ..... A47G 21/14
(Continued)

(56) References Cited

U.S. PATENT DOCUMENTS 1,594,401 A * 8/1926 Zeitung ..... A47G 21/14 206/553
2,357,646 A * 9/1944 Gilbert ..... A47G 21/14 206/565

(Continued)

FOREIGN PATENT DOCUMENTS

BE 628225 A 10/1969
DE 889351 C * 9/1953 ..... A47G 21/14

(Continued)

OTHER PUBLICATIONS

International Search Report (dated Aug. 10, 2016) for corresponding International App. PCT/EP2016/062403.d

*Primary Examiner* — Stanton L Krycinski
(74) *Attorney, Agent, or Firm* — WRB-IP LLP

(57) ABSTRACT

A retaining block for a cutlery-storage system for one or more items of cutlery includes an elongated base body, wherein the base body has a handle-region receiving portion for accommodating a handle region of at least one first item of cutlery and a tool-region receiving portion for accommodating a tool region of at least one other item of cutlery, and the handle-region receiving portion and the tool-region receiving portion are arranged so as to overlap at least partially. The handle-region receiving portion has a comb-like structure for accommodating a plurality of items of cutlery arranged one after the other along the longitudinal extension, in particular with the items of cutlery arranged in a single layer, wherein items of cutlery placed in the handle-region receiving portion can be accommodated in a lateral orientation with respect to their tool region such that broad sides of the tool regions follow one after the other in the longitudinal extension. A cutlery-storage system having such retaining blocks is also provided.

15 Claims, 11 Drawing Sheets

(58) Field of Classification Search
USPC ..... 211/70.7
See application file for complete search history.

(56) References Cited

U.S. PATENT DOCUMENTS

| | | | | | |
|---|---|---|---|---|---|
| D149,540 | S | | 5/1948 | Case et al. | |
| D158,816 | S | * | 5/1950 | Thatcher | 211/70.7 |
| 2,924,410 | A | * | 2/1960 | Davis | A47G 21/14 211/70.1 |
| 3,703,326 | A | | 11/1972 | Riviers | |
| 3,915,213 | A | * | 10/1975 | Graham, Jr. | A47G 21/14 206/373 |
| 4,305,629 | A | | 12/1981 | Friis | |
| 5,725,108 | A | * | 3/1998 | Olson | A47G 21/14 211/70.7 |
| 6,012,584 | A | * | 1/2000 | Dawson | A45C 5/03 206/372 |
| 8,348,068 | B2 | * | 1/2013 | Huentelman | A47J 47/16 211/70.7 |
| 8,746,467 | B2 | * | 6/2014 | Jeong | A47L 15/502 211/126.2 |
| 9,140,482 | B2 | * | 9/2015 | Popovitch | F25D 25/021 |
| 2012/0181242 | A1 | | 7/2012 | Jeong | |
| 2012/0279935 | A1 | * | 11/2012 | McNally | A47G 21/14 211/70.7 |
| 2014/0091508 | A1 | * | 4/2014 | Chalifoux | A47J 47/005 269/16 |
| 2014/0338708 | A1 | | 11/2014 | Boyd et al. | |

FOREIGN PATENT DOCUMENTS

| | | | | | |
|---|---|---|---|---|---|
| DE | 1260727 | B | * | 2/1968 | A47G 21/14 |
| DE | 1554519 | A1 | * | 1/1970 | A47G 21/14 |
| DE | 19626677 | A1 | * | 1/1998 | A47G 21/14 |
| DE | 19823808 | A1 | | 12/1999 | |
| DE | 102005056886 | B3 | | 2/2007 | |
| EP | 2742831 | A1 | | 6/2014 | |
| FR | 1581740 | A | * | 9/1969 | A47G 21/14 |
| FR | 2338669 | A1 | * | 8/1977 | A47G 21/14 |
| FR | 2450582 | A1 | * | 10/1980 | A47F 5/0846 |
| GB | 191421111 | A | * | 9/1915 | A47G 21/14 |

* cited by examiner

RETAINING BLOCK FOR A CUTLERY-HOLDER SYSTEM FOR ONE OR MORE ITEMS OF CUTLERY, AND CUTLERY-HOLDER SYSTEM HAVING AT LEAST TWO RETAINING BLOCKS

STATE OF THE ART

The invention relates to a retaining block for a cutlery-storage system for one or more items of cutlery and a cutlery-storage system having at least two retaining blocks.

Various cutlery-storage systems are known in which items of cutlery can be stored in a sorted or unsorted manner.

In canteens, for example, items of cutlery are stocked in large quantities in trays, from which users take out the items individually. In general, a user cannot avoid touching several items in the tray, which are then taken out by another user.

U.S. Pat. No. 3,703,326 A discloses a storage system for a household drawer in which storage compartments are provided which run at an angle and in which items of cutlery can be inserted to save space in the drawer.

In U.S. Pat. No. 4,305,629 A a cutlery-storage system for a household drawer is disclosed in which a retaining block is provided which can receive items of cutlery in two horizontal layers. In a lower layer slots are provided in the cutlery retaining block in which knives can be inserted individually. In a layer above, spoons and forks can be placed flat in the gaps of a comb structure, wherein they can be stacked in layers on top of each other. These items of cutlery are placed directly above the knives. The retaining block consists of individual segments that can simply be put together and the assembled segments can be clamped in the drawer by means of spring force.

DISCLOSURE OF THE INVENTION

The object of the invention is to provide a retaining block for a cutlery-storage system.

Another object is to provide a cutlery-storage system having at least one retaining block, in which large numbers or items of cutlery can be presented and removed in a hygienic manner.

The objects are achieved by the characteristics of the independent claims. Favorable embodiments and advantages of the invention can be seen from the other claims, the description and the drawings.

According to one aspect, a retaining block for a cutlery-storage system having a base body is proposed, having a height in the direction of a vertical axis, a width in the direction of a transverse axis and a longitudinal extension perpendicular to the vertical axis and transverse axis, wherein the base body is provided for placement on a mounting surface of a substrate. The base body has a handle-region receiving portion for accommodating a handle region of at least one first item of cutlery and a tool-region receiving portion for accommodating a tool region of at least one other item of cutlery. The handle-region receiving portion and the tool-region receiving portion are arranged so as to overlap at least partially in the direction of the vertical axis. In the inserted state, items of cutlery extend perpendicular to the longitudinal extension. Along the longitudinal extension, the handle-region receiving portion has a comb-like structure for accommodating a plurality of items of cutlery arranged one after the other along the longitudinal extension, in particular with the items of cutlery arranged in a single layer, wherein items of cutlery placed in the handle-region receiving portion can be accommodated in a lateral orientation with respect to their tool region such that broad sides of the tool regions follow one after the other in the longitudinal extension.

In this case, at least the narrow sides of the tool regions point towards the mounting surface, for example, the knife blade or the lateral edge of prongs or spoon bowls.

The comb-like structure of the handle-region receiving portion has consecutively alternate partitions and gaps for accommodating the handle regions of the items of cutlery in the gaps.

For accommodating items of cutlery in the form of knives the tool-region receiving portion has slots for receiving the knife blades which are laterally limited by the contact surfaces of the tool-region receiving portion, wherein the gaps of the handle-region receiving portion facing the tool-region receiving portion are open with slots, such that, during insertion, the knife blades can be guided below the handle-region receiving portion through the slots into the slots of the tool-region receiving portion.

The knives can be accommodated in the slots in a protective and user-safe manner with their blades. If the gaps of the handle-region receiving portion are open towards the tool-region receiving portion, the knives can slide from above into the slots of the tool-region receiving portion and can also be easily removed again. If a closure strip for the free ends of the knife handles is provided on the handle-region receiving portion, the knife which is being taken out can be reliably prevented from unintentionally pushing out another knife in a retaining block arranged on the tool-region side.

For accommodating cutlery in the form of spoons and/or forks, the tool-region receiving portion is concave shaped having a comb structure on its front face for receiving free ends of the tool regions of the items of cutlery, wherein the comb structure has consecutively alternate partitions and gaps for accommodating the free ends in the gaps and the partitions form the contact surfaces.

If the tool region comes into contact with the comb structure when inserting the items of cutlery, these are guided into their final position virtually in a self-aligning manner. Items of cutlery can be inserted very quickly. Advantageously, the comb structure may be configured such that a contact surface for the tool region of the item of cutlery serves as a guide surface, so that the item of cutlery can easily slide into its final position in the tool-region receiving portion as soon as the free end of the tool region comes into contact with the contact surface when the item of cutlery is inserted.

The handle region of the item of cutlery is the area where the item of cutlery is usually held when used. The tool region is the area where the item of cutlery is usually brought into contact with food, i.e. prongs on a fork, knife blade on a knife, spoon bowl on a spoon, etc.

In the intended use state the retaining block, in particular a plurality of retaining blocks, is equipped with items of cutlery and arranged in particular on a base element such that the items of cutlery are inclined in the described manner from top to bottom.

The mounting surface of the retaining block is the horizontal surface on which the retaining block rests during intended use. The retaining block may have a bottom, which is formed by a more or less continuous surface, or stand on feet or a frame.

Due to the inclination of the items of cutlery, cutlery can be presented in a space-saving manner by partially overlapping layers of the items of cutlery while being easily accessible to a user. In doing so, the cutlery is arranged side by side in a single layer each in individual layers, and items of cutlery can be removed individually without being forced to touch other items of cutlery in order to select one item of cutlery, especially not in the tool region of an item of cutlery that another user wants to use later. As a result, a high standard of hygiene can be provided, even if a large number of users access the items of cutlery. Different retaining blocks can be provided for different types of cutlery, for example on the one hand for knives and on the other hand for forks and/or spoons. The cutlery can be quickly sorted and relieves the service and kitchen staff. In use, a high standard of hygiene can be ensured when removing the items of cutlery.

According to a favorable embodiment, the handle-region receiving portion may have an angle of inclination with respect to a horizontal mounting surface of the retaining block such that, in the intended use state, starting from the handle region, the inserted item of cutlery is inclined with respect to the mounting surface by the angle of inclination.

According to a favorable embodiment, the comb-like structure of the handle-region receiving portion may have consecutively alternate partitions and gaps for accommodating the handle regions of the items of cutlery in the gaps, where the partitions have a tilt angle with respect to a vertical, which may be arranged perpendicular to the mounting surface.

Due to the tilt angle, the items of cutlery are slightly inclined to the side along the longitudinal extension of the retaining block. This has the advantage that the items of cutlery assume a stable preferential direction and allow for a particularly easy sorting when sorting into the retaining block, in particular in conjunction with a plurality of retaining blocks placed parallel to their longitudinal extension. The tilt angle can be small and amount to only a few degrees. Advantageously, a tilt angle between 1° and 15°, preferably between 2° and 10°, is provided. Due to the slight inclination, the items of cutlery slide into their rest position particularly easily.

According to a favorable embodiment, the tool-region receiving portion may have contact surfaces for the tool regions, which contact surfaces may have a tilt angle with respect to a vertical which may be arranged perpendicular to the mounting surface.

This tilt angle, too, has the advantage that the items of cutlery assume a stable preferential direction and allow for a particularly easy sorting when sorting into the retaining block, in particular in conjunction with a plurality of retaining blocks placed parallel to their longitudinal extension. The tilt angle can be small and amount to only a few degrees. Advantageously, a tilt angle between 1° and 15°, preferably between 2° and 10°, is provided. Due to the slight inclination, the items of cutlery slide into their rest position particularly easily.

According to a favorable embodiment, the tilt angles of the partitions and the contact surfaces can be identical. This simplifies the manufacture of the retaining blocks.

According to a favorable embodiment, a closure strip may be provided on the handle-region receiving portion for free ends of the handle regions of the items of cutlery. The items of cutlery can be positioned in a defined orientation. Likewise, the closure strip facilitates the insertion of the items of cutlery. Particularly advantageous is a closure strip on a retaining block which is specially designed for knives.

According to a favorable embodiment, the retaining block may have at least one positioning means to position and optionally fix the base body of the retaining block on a base element in the use state. Thus, distances between retaining blocks arranged parallel to the longitudinal extension can be adjusted in a flexible manner and thus adjusted to different cutlery lengths. The retaining blocks are arranged in a stable way as an ensemble on the base element and withstand dynamic loads during loading and transportation as well as during removal and cleaning.

Another aspect of the invention relates to a cutlery-storage system having a base element on which at least one retaining block for a cutlery-storage system for one or more items of cutlery is accommodated, wherein the items of cutlery each have a handle region and a tool region, and wherein the retaining block has a handle-region receiving portion and a tool-region receiving portion, which handle-region receiving portion is arranged, in the intended use state, above the tool-region receiving portion, wherein a plurality of items of cutlery can be accommodated adjacent to each other along their longitudinal extension.

It is proposed that at least two retaining blocks are arranged on the base element along a longitudinal axis of the base element.

A system, which is designed flexibly with regard to size and which can be easily adapted for different types of cutlery and/or sizes of cutlery and/or quantities of cutlery, can be provided.

Various types of cutlery, such as knives, forks and spoons, may each be stored logistically in different sizes, in a small space in large quantities. The provision of large quantities of assorted items of cutlery prolongs the refilling interval, which can relieve the catering staff and as a result can save time and money.

According to a favorable embodiment, the retaining blocks may be lined up on the base element, wherein in particular at least one of the retaining blocks is screwed, clamped, intermeshed or latched to the base element.

According to a favorable embodiment, the retaining blocks may be lined up on the base element along a rail, wherein in particular at least one of the retaining blocks may be screwed, clamped, intermeshed or latched to the base element. A releasable attachment of the retaining blocks on the base element is of advantage. Alternatively, one or more retaining blocks may be permanently connected to the base element.

Conveniently, the individual components or even the assembled cutlery-storage system can be hygienically cleaned in dishwashers, which is advantageous particularly in canteen kitchens and for events. A high standard of hygiene can be maintained from the insertion of the items of cutlery via the transportation of the fully equipped cutlery-storage system and the removal of the items of cutlery to the cleaning of the cutlery-storage system.

According to a favorable embodiment, a retaining block may be provided as a first end piece which may be configured without a handle-region receiving portion, but with a tool-region receiving portion. This end piece may be provided as the last retaining block of a series of retaining blocks arranged parallel to their longitudinal extension. The total weight of the system is reduced. Alternatively, a conventional retaining block having a handle-region receiving portion may be provided.

According to a favorable embodiment, a retaining block may be provided as a second end piece which may be configured without a tool-region receiving portion, but with a handle-region receiving portion. This end piece can be provided as the first retaining block in a series of retaining blocks arranged parallel to their longitudinal extension. The total weight of the system is reduced. Alternatively, a conventional retaining block having a tool-region receiving portion may be provided.

According to a favorable embodiment, items of cutlery may be arranged in a single layer on the retaining blocks. This allows a decorative presentation and hygienically clean application. At the same time, the cutlery can be removed very easily and without problems.

According to a favorable embodiment, handle regions of the items of cutlery may be arranged cantilevered between the retaining blocks. This allows the cutlery to be gripped and removed at a defined region.

According to a favorable embodiment, at least one of the retaining blocks may be illuminated or coupled to a lighting device. This allows a particularly visually appealing and effective presentation of the items of cutlery.

Advantageously, the retaining blocks may be made of plastic material, in particular food-safe plastic material.

DRAWINGS

Further advantages result from the following description of the drawings. In the drawings, embodiments of the invention are shown. The drawings, the description and the claims contain numerous characteristics in combination. The person skilled in the art will expediently also consider the characteristics individually and combine them into meaningful further combinations.

It is shown by way of example:

EMBODIMENTS OF THE INVENTION

In the figures, like or equivalent components are numbered with the same references. The figures are merely examples and are not meant to be limiting.

Directional terminology used in the following with terms such as "left", "right", "top". "bottom", "before" "behind", "after" and the like is only intended for a better understanding of the figures and is n no case a limitation of generality. The components and elements shown, their design and use may vary in the light of considerations of one skilled in the art and be adapted to the respective applications.

Figure 1:
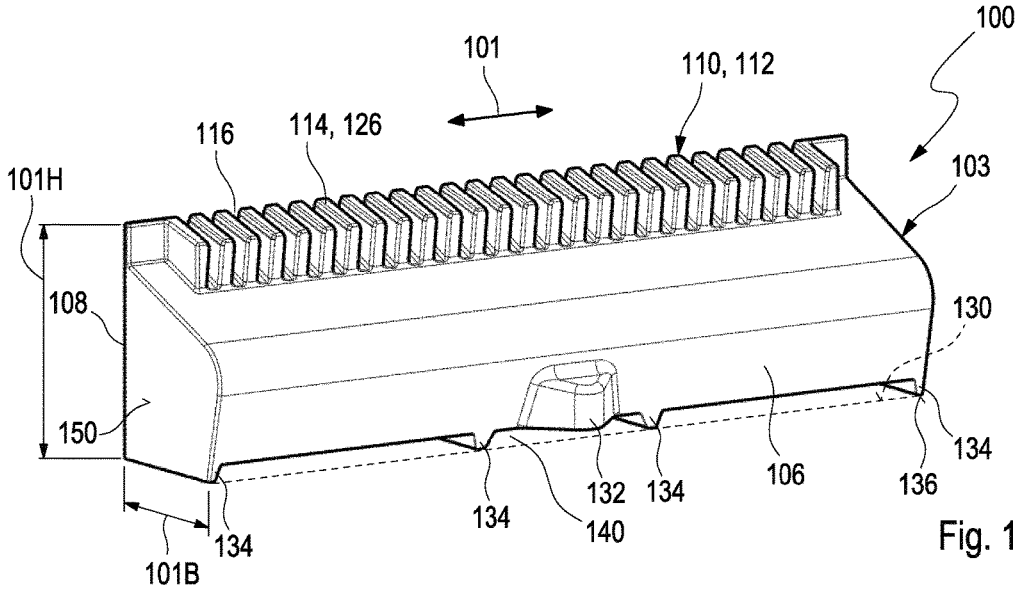
FIG. 1 shows an isometric view of a retaining block according to an embodiment of the invention from its front side, which can be used in particular for spoons and forks.
Figure 8:
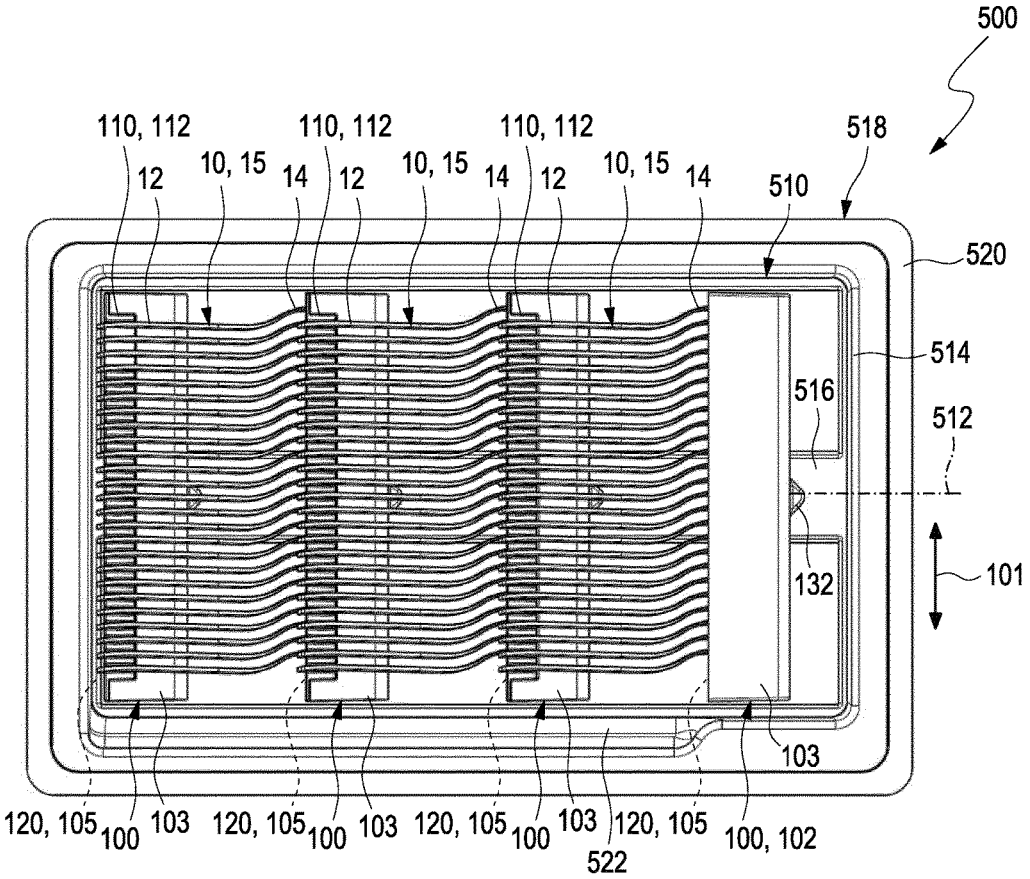
FIG. 8 shows a plan view of a cutlery-storage system according to an embodiment of the invention with inserted forks in an intended use state.
Figure 9:
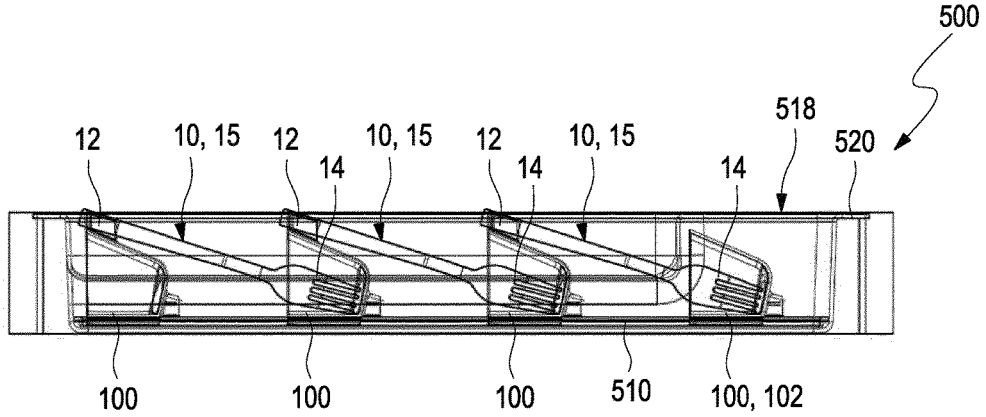
FIG. 9 shows a partially transparent side view of the cutlery-storage system of FIG. 8 with four retaining blocks.

FIGS. 1 to 5 show various views of a retaining block 100 according to an exemplary embodiment of the invention which is particularly suitable for spoons and forks 15 as items of cutlery 10. FIG. 1 shows an isometric view of a retaining block 100 from its front side 106, FIG. 2 a view of a side surface 150 of the retaining block 100, FIG. 3 a view from its rear side, FIG. 4 a plan view and FIG. 5 a front view of the retaining block 100. The retaining block 100 is advantageously provided for use in a cutlery-storage system 500 (FIGS. 8, 9). The illustrated retaining block 100 is particularly suitable for forks and spoons.

The retaining block 100 consists of a base body 103. The base body 103 is elongated with a longitudinal extension 101, a width in a direction of a transverse axis 101B and a height in a direction of a vertical axis 101H, wherein the longitudinal extension 101, transverse axis 101B and vertical axis 101H are oriented perpendicular to each other.

The retaining block 100 has a front side 106 and a rear side 108 as well as a handle-region receiving portion 110 and a tool-region receiving portion 120, wherein, in the intended use state, the handle-region receiving portion 110 is located above the tool-region receiving portion 120 and overlaps this in the direction of the vertical axis 101H. The handle-region receiving portion 110 is provided to accommodate the rear end of the handle region of a first item of cutlery, while the tool-region receiving portion 120 is provided to accommodate the tool region of a further item of cutlery. In the inserted state, each item of cutlery is in contact with two retaining blocks 100. The item of cutlery rests with the end piece of its handle region on the handle-region receiving portion 110 on the one retaining block 100 and projects with its tool region through the rear side 108 of the next retaining block 100 into the tool-region receiving portion 120.

The retaining block 100 accommodates a plurality of items of cutlery in a single layer. In doing so, the items of cutlery lie in a space-saving manner in a lateral orientation, so that their tool regions (forks, spoon bowl, knife blade) are arranged perpendicular to the mounting surface 130.

In its intended use state, the retaining block 100 rests with its base body 103 on a horizontal mounting surface 130. In the embodiment shown in FIGS. 1-5, the retaining block 100 rests on the mounting surface 130 with contact surfaces 136 of a plurality of ridges 134, 135 arranged on its bottom side which are arranged transversely, laterally and in the interior of the bottom side of the retaining block 100. The transverse strip 135 is disposed on the rear side 108 where it connects the outer and the next inner strip 134 in each case. In the middle, between the inner strips 134, a tunnel 140 is formed which advantageously serves to stably align the retaining block 100. Optionally, the bottom side of the base body 103 can also be designed to be flat, or, additionally or alternatively, ridges may be provided on the front side 106 and/or on the rear side 108 of the base body 103, or feet may be provided.

Figure 2:
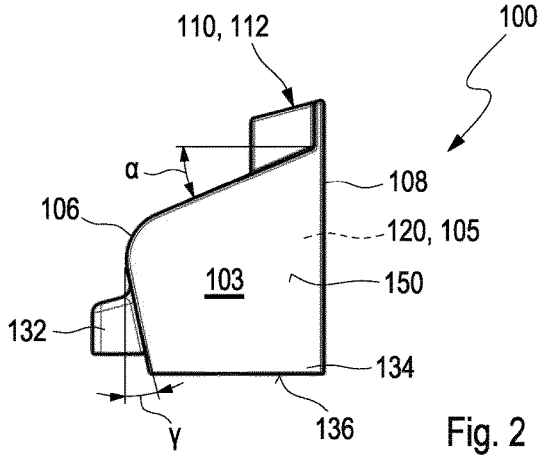
FIG. 2 shows a side view of the retaining block of FIG. 1.

As the view on the side surface 150 in FIG. 2 shows, the handle-region receiving portion 110 has an angle of inclination $\alpha$ with respect to the mounting surface 130 and thus with respect to the contact surfaces 136 of the retaining block 100 such that, in the intended use state, starting from the handle region 12 (FIG. 9), the inserted item of cutlery 10 (FIG. 9) is inclined with respect to the mounting surface 130 by the angle of inclination $\alpha$. In doing so, the entire handle-region receiving portion 110 may be inclined in this manner, or only the comb-like structure 112, in particular at the bottom of the handle-region receiving portion 110. The front side 106 of the retaining block 100 is inclined outward at an angle $\gamma$, for example, corresponding to the angle of inclination $\alpha$.

The comb-like structure 112 of the handle-region receiving portion 110 is provided along the longitudinal extension 101 of the retaining block 100 to accommodate the item of cutlery 10 (FIG. 9) in a lateral orientation in relation to its tool region 14 (FIG. 9) such that a narrow side of the tool region 14 rests thereon and the tool region 14 is aligned perpendicular to the mounting surface. In this exemplary embodiment the comb-like structure 112 starts from the rear side 108 of the retaining block 100 and extends in the transverse direction 101B partially across the handle-region receiving portion 110.

In the comb-like structure 112 of the handle-region receiving portion 110, partitions 114 and gaps 116 follow in consecutively alternate order, in which gaps 116, handle regions 12 of the items of cutlery 10 (FIG. 9) are inserted. Optionally, the handle-region receiving portion 110 may also be provided with a closure strip 113 (see, for example, FIG. 10 and FIG. 20), so that the handle region 12 of an item of cutlery 10 (FIG. 9) cannot project over the retaining block 100 with its free end.

The partitions 114 have a tilt angle ß1 with respect to a vertical V, which is oriented perpendicular to the mounting surface 130. Thus, the inserted item of cutlery 10 (FIG. 9) tilts by this tilt angle $\beta$1 and arrives in a stable position. The tilt angle ß1 may be small, in particular 10° at most. The partitions 114 form lateral contact surfaces 126 for the free ends of the handle regions 12 of the items of cutlery 10 (FIG. 9). For conventionally shaped items of cutlery 10 narrow sides of the items of cutlery 10 are also narrow sides of the tool regions 14 and the handle regions 12. In this case, the handle regions 12 lie in the comb-like structure 112 with their narrow sides facing down. If the narrow sides of the handle region 12 are arranged at an angle with respect to the narrow sides of the tool region 14, the comb-like structure 112 may be correspondingly formed with larger gaps.

The vertical V and the vertical axis 101 H may conveniently coincide.

Figure 3:
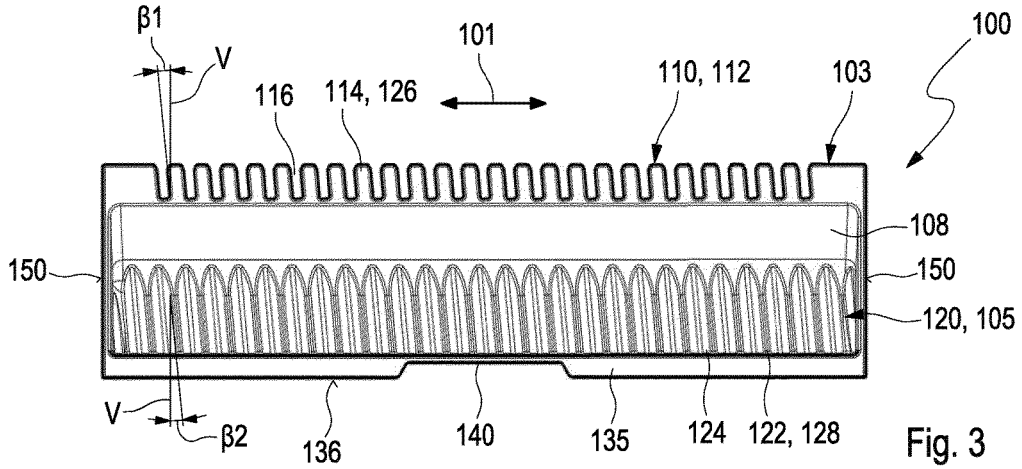
FIG. 3 shows a view of the retaining block of FIG. 1 from its rear side.
Figure 4:
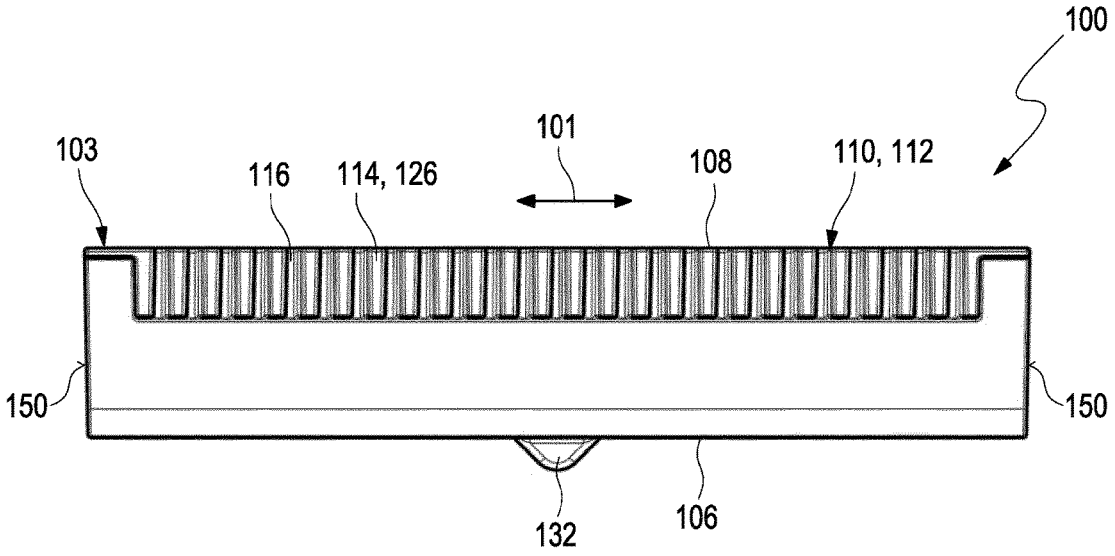
FIG. 4 shows a plan view of the retaining block of FIG. 1.
Figure 5:
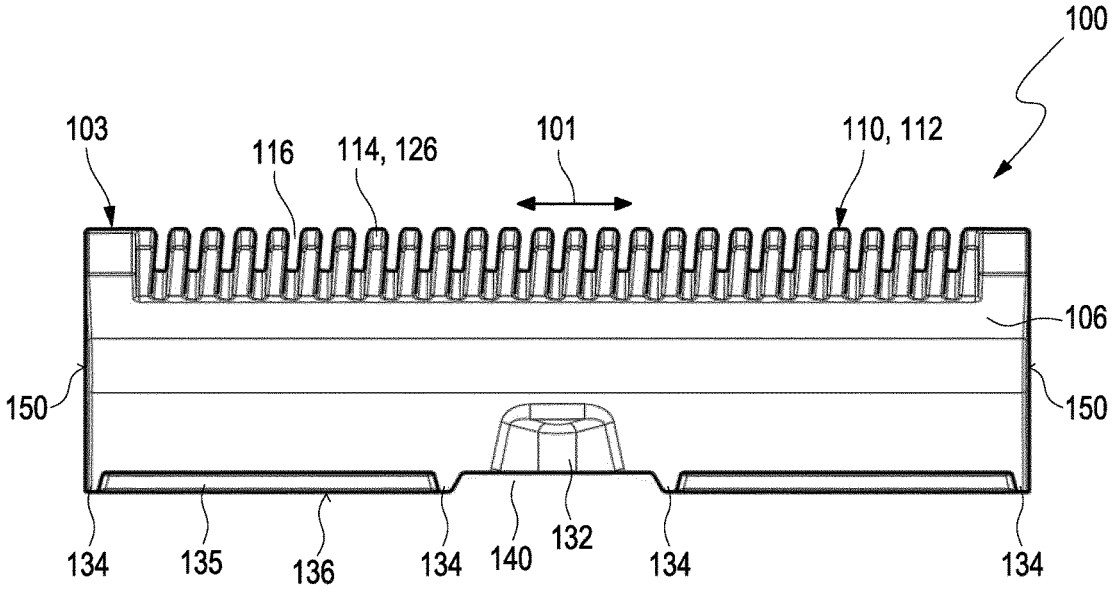
FIG. 5 shows a front view of the retaining block of FIG. 1.

The tool-region receiving portion 120, which can be seen in FIG. 3 below the handle-region receiving portion 110 of the same retaining block 100 when looking on the rear sides 108, is provided with a frontal comb structure 105 with consecutively alternate partitions 122 and gaps 124 for receiving free ends of the tool regions 14 of the items of cutlery 10 (FIG. 9) in the gaps 124. The partitions 122 form lateral contact surfaces 128 for the tool regions 14 (FIG. 9), which are inserted into the comb structure 105 with their narrow sides facing downward.

The contact surfaces have a tilt angle ß2 with respect to the vertical V, wherein, advantageously, the two tilt angles ß1 and ß2 may be identical. The tilt angle $\beta$2 guides the tool regions 14 of the items of cutlery 10 (FIG. 9) into a stable position, so that a larger quantity of items of cutlery 10 (FIG. 9) can be inserted particularly easily and quickly.

The tool-region receiving portion 120 is concave shaped and, for example, closed on the front side 106 of the retaining block 100, i.e. the gaps 124 have a bottom. Advantageously, the front side 106 inclined outwardly by the angle $\gamma$ results in that for example, prongs of forks completely submerge in the comb structure 105 and, for example, can abut the rear side of the closed front side 106. This improves guiding of the items of cutlery when inserting the same.

On the front side 106 of the retaining block 100, a projection 132 is provided adjacent to the tunnel 140 of the retaining block 100 as a positioning means for the retaining block 100 (FIGS. 1, 2, 4, 5), which serves to lock the retaining block 100. With its bottom side, the projection 132 terminates flush with the top 107 of the tunnel 140 and forms, for example, a screw dome for receiving a screw, with which the retaining block 100 may be screwed to a base element or a base plate.

Figure 6:
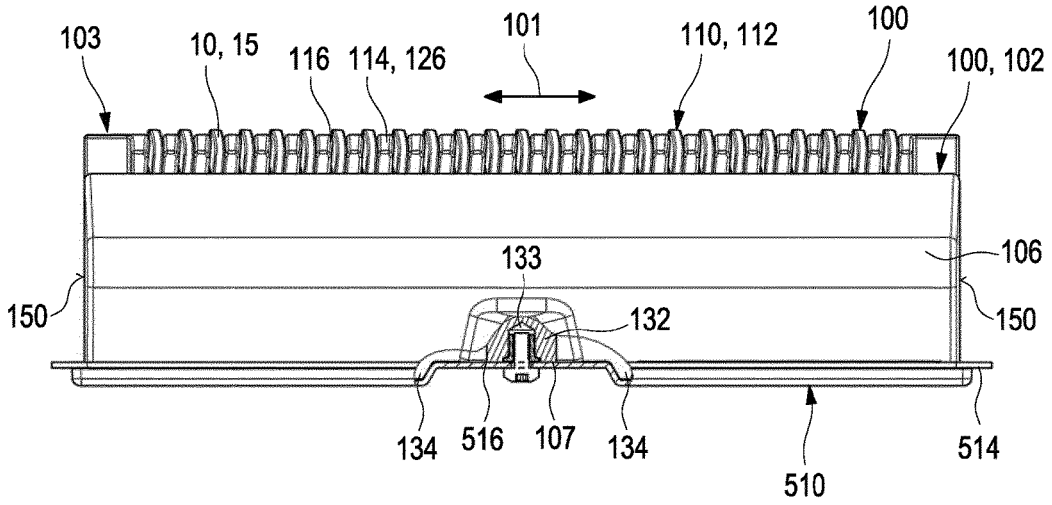
FIG. 6 shows a partially cut view of the retaining block of FIG. 1, which is placed on a base element and screwed thereto, with forks inserted.

FIG. 6 shows a partially cut view of the retaining block 100 of FIG. 1 which is located on a base element 510 and bolted thereto, with inserted forks 15 as cutlery elements 10, the free ends of the handle regions of which are to be seen. The base element 510 is designed here as a flat plate. The inner ridges 134 enclose a rail 516 of the base element 510 between them and also stabilize the assembly with cutlery inserted. At least one of a plurality of retaining blocks 100, e.g. the foremost one, may be screwed to the base element 510 to fix its position on the rail 516. For this purpose, the projection 132 is formed at the front side 106 the base body 103, in the interior of which a hole 133 is provided, into which a screw can be screwed in from the base element 510. Other, in particular releasable, attachment types, such as a latching connection and the like, are also conceivable.

As a result of the projection 132, which is arranged outside the tool-region receiving portion 120, the bottom of the tool-region receiving portion 120 can be made very thin.

Figure 7:
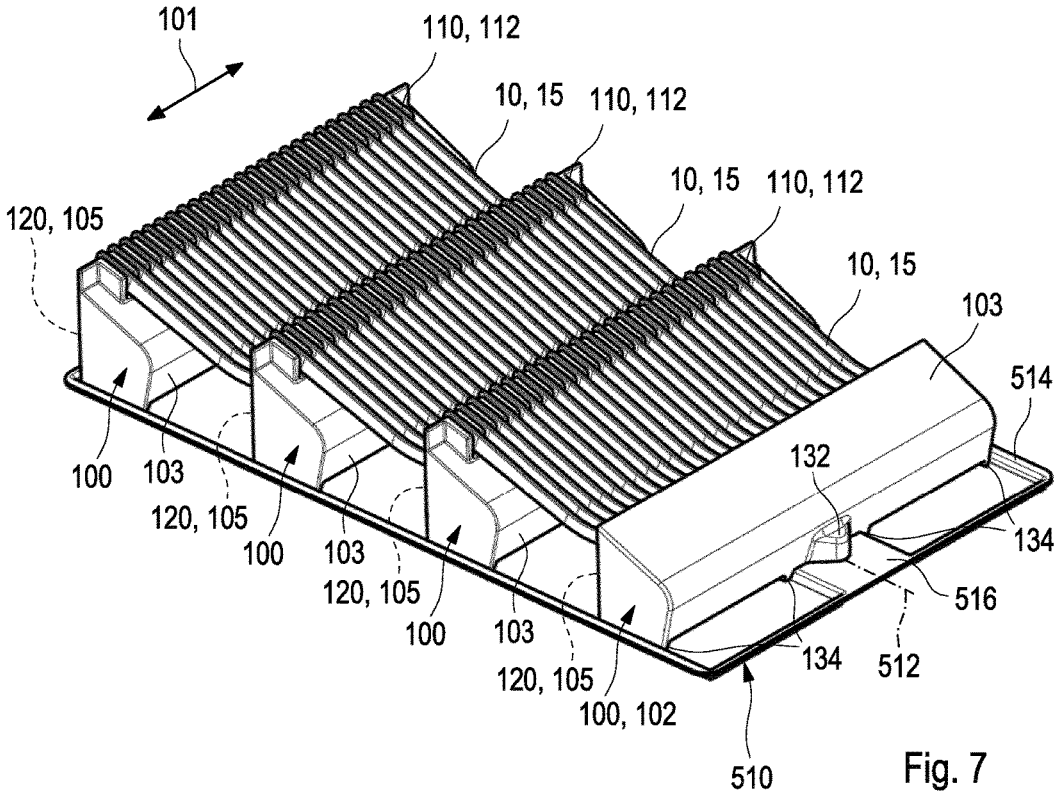
FIG. 7 shows an isometric view of a plurality of retaining blocks according to FIG. 1, which are arranged parallel to their longitudinal extension on a base element according to an exemplary embodiment of the invention with inserted forks.

FIG. 7 shows an isometric view obliquely from above of several retaining blocks 100 according to FIG. 1, which are arranged parallel to their longitudinal extension 101 on a base element 510, according to an exemplary embodiment of the invention and with inserted items of cutlery 10 in the form of forks 15. FIG. 8 shows a plan view of a cutlery-storage system 500 according to an exemplary embodiment of the invention with inserted base element 510, which is loaded with retaining blocks 100 and inserted forks 15 in an intended use state. FIG. 9 shows a partially transparent side view of the cutlery-storage system 500 from FIG. 8.

Four retaining blocks 100 are mounted on the plate-shaped base element 510 and rest with their tunnels 140 over the rail 516 of the base element 510, which extends along a longitudinal axis 512 of the base element 510. The retaining blocks 100 are arranged with their longitudinal extension 101 perpendicular to the longitudinal axis 512. The base element 510 has a low peripheral rim 514 which, together with the rail 516 and the ridges 134 of the retaining blocks 100, stabilizes the assembly. The retaining blocks 100 are laterally flush with the rim 514; the rearmost retaining block 100 also terminates flush with the edge 514 with its rear side. Despite the high weight when fully loaded with items of cutlery 10, the combination of retaining blocks and base element 510 is stable and torsionally rigid, so that the assembly can also be transported safety.

The four retaining blocks 100 accommodate three single-layered cutlery layers of items of cutlery 10 of, for instance, 25 forks each. The free ends of the handle regions 12 of the forks 15 rest on the handle-region receiving portion 110 of a retaining block 100, while the prongs of the forks (tool region 14) completely submerge in the tool-region receiving portion 120 of the next retaining block 100. The tool region 14 of the inserted items of cutlery 10 is therefore hygienically protected from contact.

Only a small segment of the free end of the handle regions 12 of the items of cutlery 10 is supported, so that each item of cutlery 10 is held only at both free ends and a large region in between is self-supporting. Therefore, an item of cutlery 10 may be easily gripped and taken out in the cantilevered region. Thus, even with a large number of accesses, the cutlery-storage system 500 or the items of cutlery 10 are not contaminated because the hand of a user comes into contact essentially with the outermost item of cutlery 10 and hardly at all with any parts of the cutlery-storage system 500. Thanks to the predetermined inclination of the items of cutlery 10, the gripped item of cutlery 10 can also be easily pulled out. Cutlery can be taken out simultaneously from each layer of cutlery of the items of cutlery 10, so that it is not necessary to empty one layer before items of cutlery 10 of the next layer are accessible.

The foremost retaining block 100 can, as illustrated, be formed as an end piece 102 and have only one tool-region receiving portion 120. The handle-region receiving portion 110 for this end piece 102 can be dispensed with. For example, the end piece may be screwed to the base element 510.

Optionally, the rearmost retaining block 100 may also be provided as an end piece having no tool-region receiving portion 120, which would be superfluous in this position, but is formed with a handle-region receiving portion 110 with a comb-like structure 112.

As can be seen in the top view in FIG. 8 and the side view in FIG. 9, the base element 510 sits with the retaining blocks 100 in a tray 518 with a border 520. The base element 510 loaded with retaining blocks 100 can be inserted into the tray 518. Optionally, the base element 510 and the tray 518 may be made in one piece with the base element 510 forming the bottom of the tray.

The border 520 can have a recess 522 on one longitudinal side, so that the items of cutlery 10 are easily accessible from this side. The recess 522 is sufficiently long that all cutlery layers are accessible. A recess on the opposite side is also conceivable, so that items of cutlery 10 could be removed from each cutlery layer from both sides.

Figure 10:
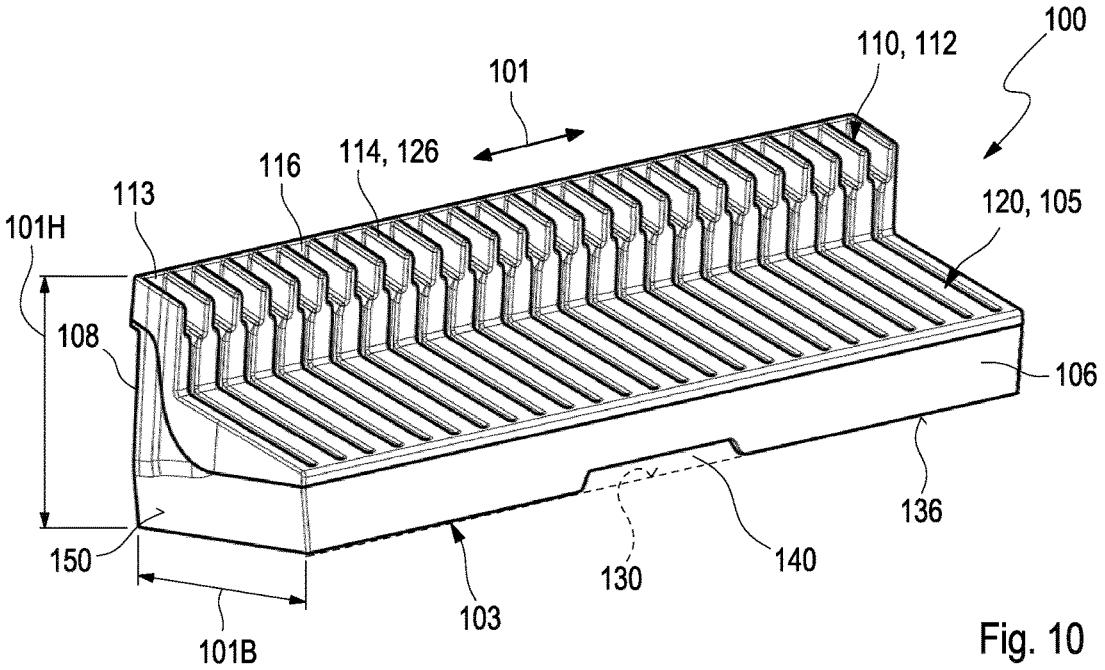
FIG. 10 shows an isometric view of a retaining block according to an exemplary embodiment of the invention from its front side, which can be used in particular for knives.
Figure 17:
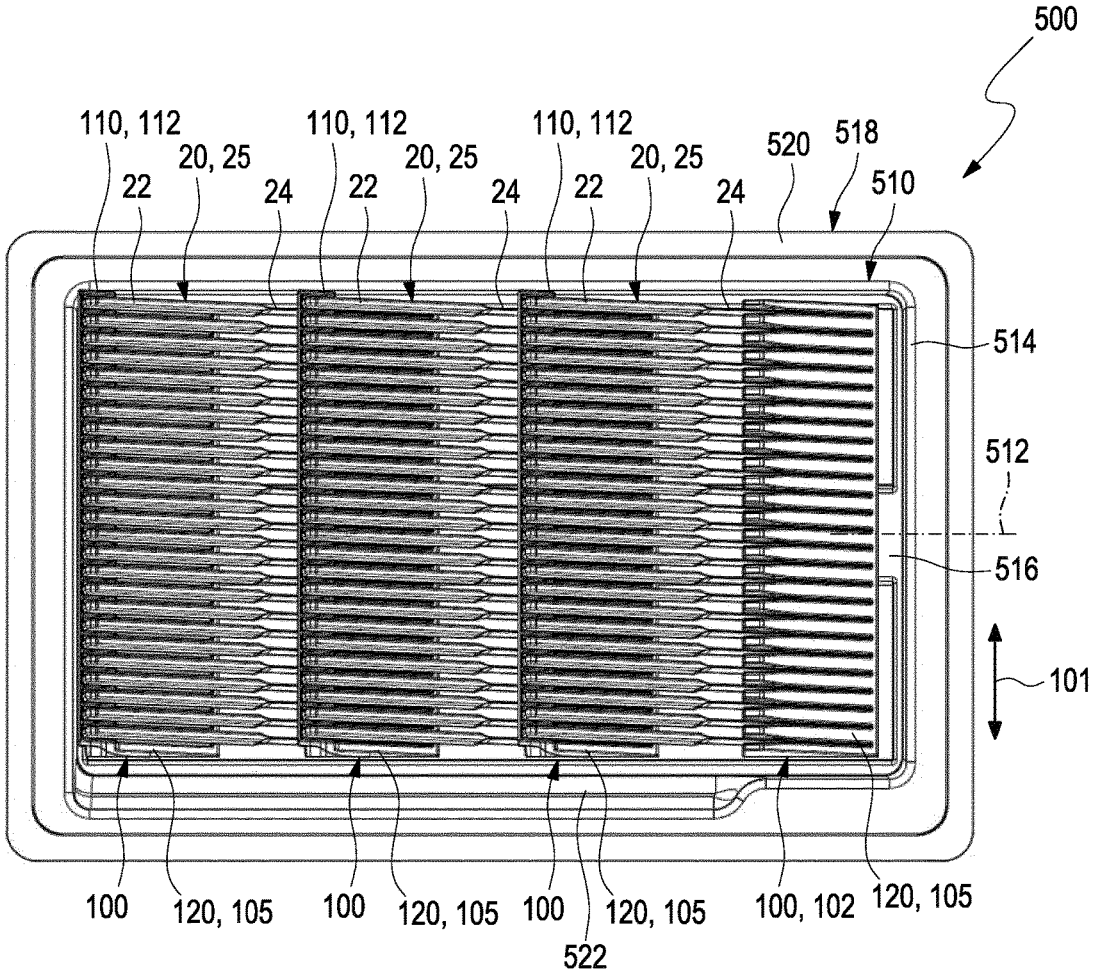
FIG. 17 shows a plan view of a cutlery-storage system according to an exemplary embodiment of the invention with inserted knives in an intended use state.
Figure 18:
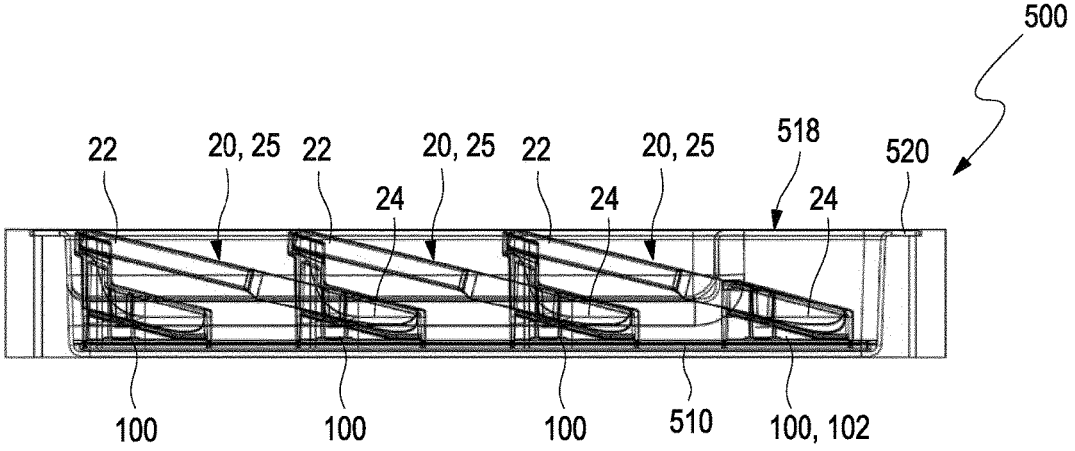
FIG. 18 shows a partially transparent side view of the cutlery-storage system of FIG. 17 with four retaining blocks.

FIGS. 10 to 14 show various views of a retaining block 100 with a base body 103 having a longitudinal extension 101 and a height in the direction of a vertical axis 101H and a width in the direction of a transverse axis 101B according to an exemplary embodiment of the invention which is particularly suitable for knives 25 as items of cutlery 20. FIG. 10 shows an isometric view of the retaining block 100 from its front side 106, FIG. 11 a view of a side surface 150 of the retaining block 100, FIG. 12 a view from its rear side 108, FIG. 13 a plan view and FIG. 14 a frontal view. The retaining block 100 is advantageously provided for use in a cutlery-storage system 500 (FIGS. 17, 18).

The retaining block 100 has a handle-region receiving portion 110 and a tool-region receiving portion 120, wherein, in the intended use state, the handle-region receiving portion 110 is arranged above the tool-region receiving portion 120 and is at least partially overlapping in the transverse direction 101B. The handle-region receiving portion 110 accommodates the handle region of an item of cutlery 20 (FIG. 16), while the tool-region receiving portion 120 accommodates the tool region of an item of cutlery 20. The item of cutlery 20 (FIG. 16) rests on a retaining block 100 with the free end of its handle region 22 and projects with its tool region 24 from the rear side 108 into the tool-region receiving portion 120 of the next retaining block 100.

For receiving items of cutlery 20 in the form of knives 25 (FIG. 16), the tool-region receiving portion 120 has a comb structure 105 which has consecutively alternate partitions 122 and gaps 124 for accommodating the blades (tool region 24) in the gaps 124, wherein the partitions 122 form contact surfaces 128.

The gaps 124 are formed as elongated slots 123 and serve to accommodate the knife blades, which are laterally limited by the contact surfaces 128 of the tool-region receiving portion 120. Advantageously, the gaps 116 of the handle-region receiving portion 110 may be open towards the tool-region receiving portion 120 with slots which are not referenced specifically. As a result, knives 25 (FIGS. 16-18) can simply be guided below the handle-region receiving portion 110 through the slots to the tool-region receiving portion 120 and slide into the slots 123 of the tool-region receiving portion 120 from above and may just as easily be pulled out obliquely upward. Advantageously, the handle-region receiving portion 110 is provided with a closure strip 113 such that, when being pulled out, the tool region 24 of a knife 25 cannot collide with an overlying knife handle (handle region 22) in another cutlery layer, since the tool region 24 of the knife 25 would impact against the closure strip 113 which serves as a barrier.

In the intended use state, the retaining block 100 rests on a horizontal mounting surface 130. In the exemplary embodiment shown, the retaining block 100 is upright. The bottom side of the retaining block 100 forms the contact surface 136 with which, in the assembled state of use, the retaining block 100 rests on the mounting surface 130. An elongated tunnel 140, which advantageously serves to stably attach the retaining block 100 on a base element, is formed in the middle.

Figure 11:
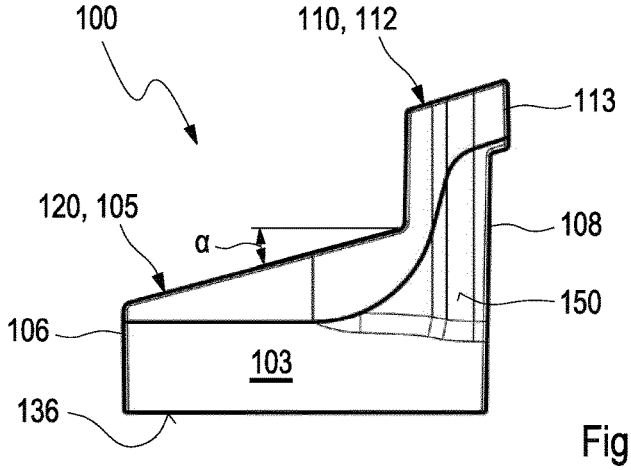
FIG. 11 shows a side view of the retaining block of FIG. 10.
Figure 16:
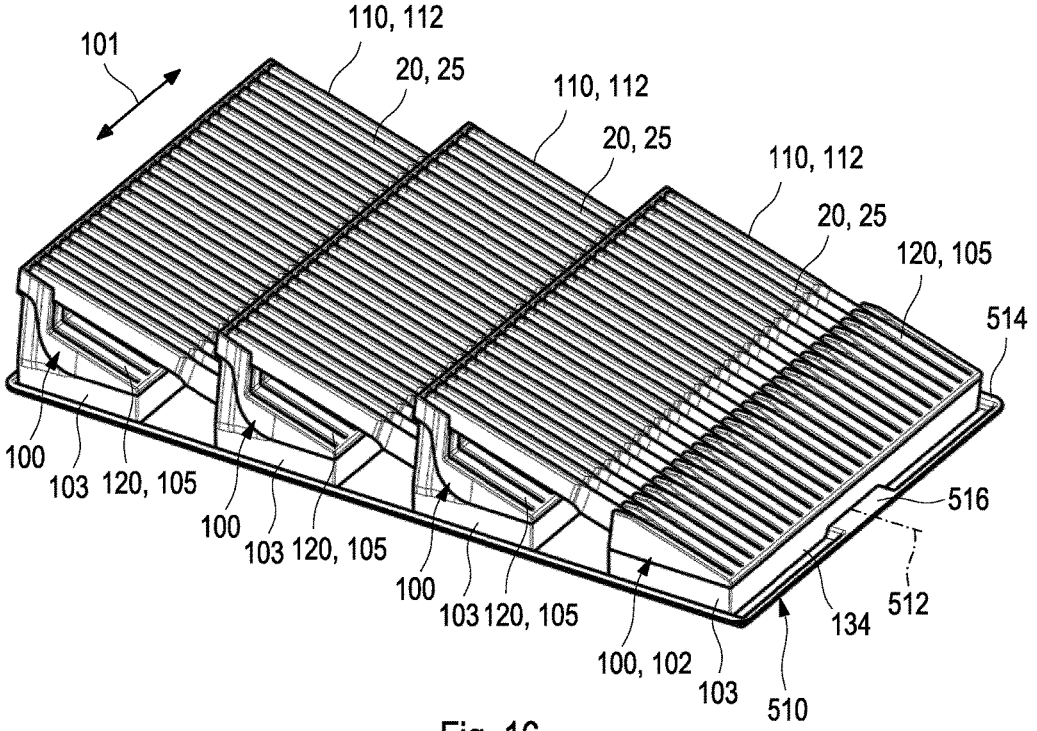
FIG. 16 shows an isometric view of a plurality of retaining blocks according to FIG. 10, which are arranged parallel to their longitudinal extension on a base element according to an exemplary embodiment of the invention with inserted knives.

As can be seen in FIG. 11, the handle-region receiving portion 110 has an inclination angle α with respect to a mounting surface 130 of the retaining block 100 so that, in the intended use state, the inserted item of cutlery 20 is inclined by the angle of inclination α to the mounting surface 130 starting from the handle portion 22 (FIGS. 16-18).

The handle-region receiving portion 110 has a comb-like structure 112 along the longitudinal extension 101 of the retaining block 100 in order to accommodate the item of cutlery 20 in a lateral orientation relative to its tool region 24. Partitions 114 and gaps 116 alternate consecutively in the comb-like structure 112 of the handle-region receiving portion 110, in which gaps 116 the handle regions of the items of cutlery 20 are inserted. The partitions 114 form contact surfaces 126 for the handle regions 24 of the items of cutlery 20.

The partitions 114 have a tilt angle ß1 with respect to a vertical V, which is arranged perpendicular to the mounting surface 130. As a result, the inserted item of cutlery 20 tilts by this tilt angle ß1 and enters a stable position. The tilt angle ß1 can be small, in particular at most 10°.

Figure 12:
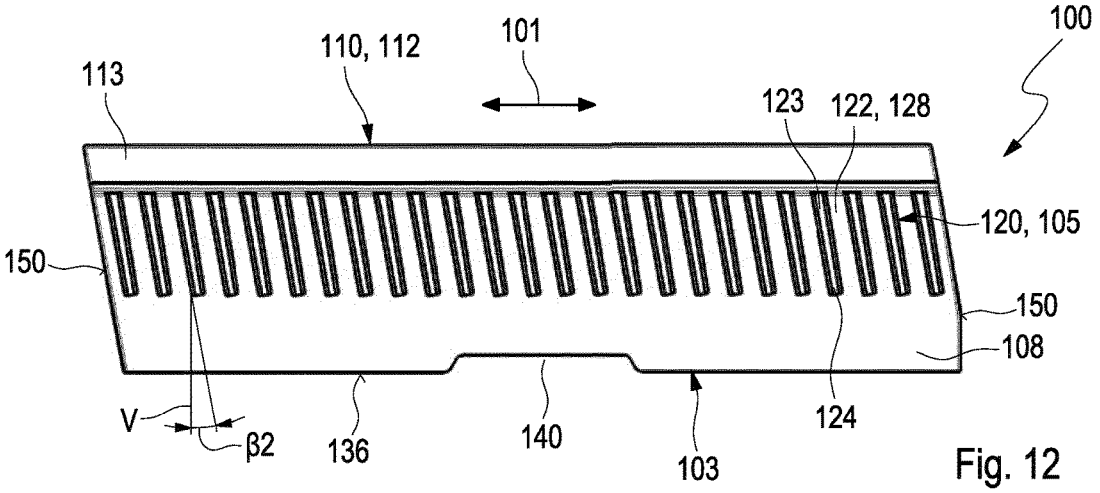
FIG. 12 shows a view of the retaining block of FIG. 10 from its rear side.
Figure 13:
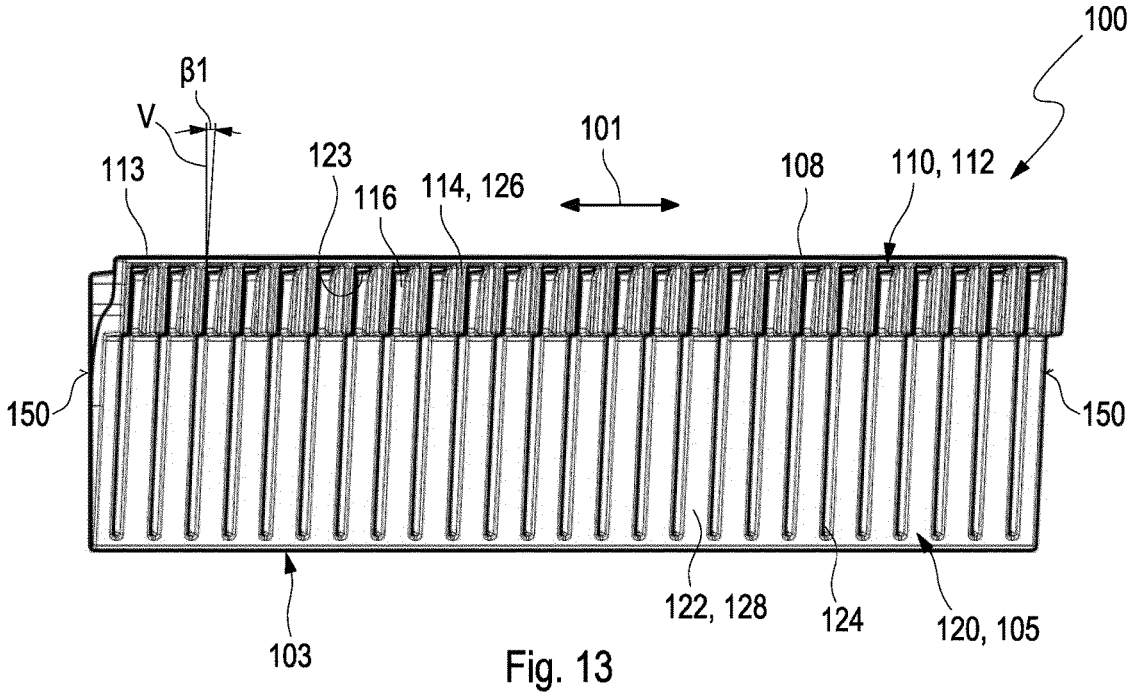
FIG. 13 shows a plan view of the retaining block of FIG. 10.
Figure 14:
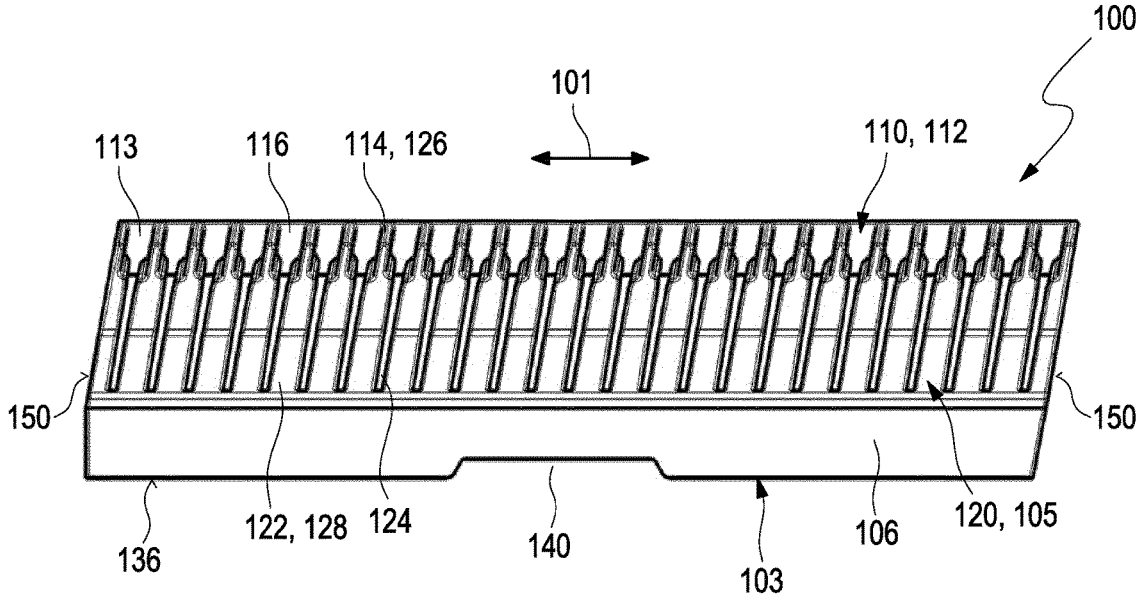
FIG. 14 shows a front view of the retaining block of FIG. 10.

The tool-region receiving portion 120, which can be seen in FIG. 12, has contact surfaces 128 for the tool regions 24 (FIG. 18), which have a tilt angle β2 with respect to the vertical V. and the two tilt angles β1 and β2 can advantageously be identical. The tool-region receiving portion 120 is slotted and has, for example, on its upper side the same inclination with the inclination angle α as the handle-region receiving portion 110 of the retaining block 100.

The tilt angle ß2 guides the tool regions 24 to a stable position such that a larger amount of items of cutlery 20 can be inserted particularly easily and quickly. The items of cutlery 20 slide quickly and safely into their final positions.

Figure 15:
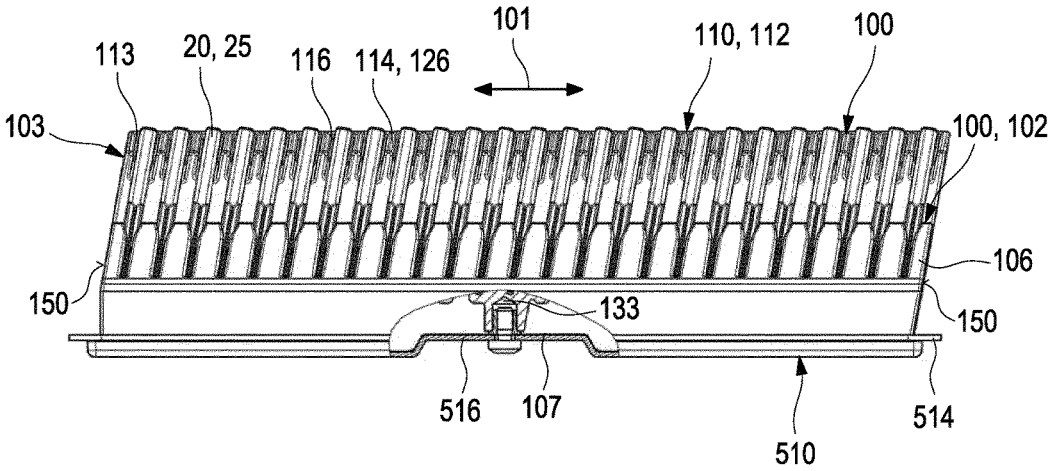
FIG. 15 shows a partially cut view of the retaining block of FIG. 10 with knives inserted, which is placed on and bolted to a base element.

On the top 107 of the tunnel 140 at the bottom side of the retaining block 100, a hole 133 is provided (FIG. 15), which serves to lock the retaining block 100. This can be seen in the partially cut view of the retaining block 100 of FIG. 10, which is placed on a base element 510 and screwed thereto. Knives 25 inserted in the retaining block 100 can also be seen partially cut.

FIG. 16 shows an isometric view of a plurality of retaining blocks 100 according to FIG. 10, which are arranged parallel to their longitudinal extension 101 on a base element 510 according to an exemplary embodiment of the invention with inserted knives 25. FIG. 17 shows a plan view of a cutlery-storage system 500 according to an exemplary embodiment of the invention with inserted base element 510, which is loaded with retaining blocks 100 and inserted knives 25 in an intended use state, and FIG. 18 shows a partially transparent side view of the cutlery-storage system 500 of FIG. 17.

Four retaining blocks 100 are mounted on the plate-shaped base element 510 and sit with their tunnels 140 over the rail 516 of the base element 510, which extends along a longitudinal axis 512 of the base element 510. The retaining blocks 100 are arranged with their longitudinal extension 101 perpendicular to the longitudinal axis 512. The base element 510 has a peripheral rim 514 which, together with the rail 516 and the ridges 134 of the retaining blocks 100, stabilizes the assembly. The retaining blocks 100 are arranged laterally flush with the edge 514 of the base element 510.

The four retaining blocks 100 accommodate three single-layered cutlery layers of items of cutlery 20 of, e.g., 25 knives 25 each. The free ends of the handle regions 22 of the knives 25 rest on the handle-region receiving portion 110 of the one retaining block 100, while the blades (tool area 24) completely submerge in the tool-region receiving portion 120 of the next retaining block 100. The tool region 24 of the items of cutlery 20 is therefore protected from contact, which, on the one hand, is hygienic and, on the other hand, also protects a user from injuries caused by knife blades.

Only a small segment at the free end of the handle regions 22 of the items of cutlery 20 is supported, so that each item of cutlery 20 is held only at both free ends and a large region in between is self-supporting. Therefore, an item of cutlery 20 may be easily gripped in the cantilevered area and taken out. Thus, even with a large number of accesses, the cutlery-storage system 500 is not contaminated because the hand of a user comes into contact essentially with the gripped item of cutlery 20 and hardly at all with parts of the cutlery-storage system 500. Thanks to the predetermined inclination of the item of cutlery 20, the item of cutlery 20 can also be easily pulled out. Cutlery can be taken out simultaneously from each layer of cutlery of the items of cutlery 20, so that it is not necessary to empty one layer before items of cutlery 20 of the next layer of cutlery are accessible.

The foremost retaining block 100 can, as illustrated, be formed as an end piece 102 and have only one tool-region receiving portion 120. The handle-region receiving portion 110 for this end piece 102 can be dispensed with. For example, the end piece may be screwed to the base element 510.

Optionally, the rearmost retaining block 100 may also be provided as an end piece having no tool-region receiving portion 120, which would be superfluous in this position, but is formed with a handle-region receiving portion 110 with a comb-like structure 112.

As can be seen in the top view in FIG. 17 and the side view in FIG. 18, the base element 510 sits with the retaining blocks 100 in a tray with a border 520 which has a recess 522 on one longitudinal side, so that the items of cutlery 20 are easily accessible from this side. The recess 522 is sufficiently long that all cutlery layers are accessible. A recess on the opposite side is also conceivable, so that items of cutlery 20 could be removed from each cutlery layer from both sides.

The handle-region receiving portion 110 is provided with a closure strip 113 in each case for the free ends of the handle regions 22 of the items of cutlery 20. Since the gaps 116 of the handle-region receiving portion 110 facing the tool-region receiving portion 120 are open, the closure strip 113 can prevent a knife 25, when being pulled out, colliding with another knife arranged above the tool region of knife 25.

The presentation of items of cutlery 10, 20 may be particularly decorative when at least one of the retaining blocks 100 is illuminated or coupled to a lighting device (not shown).

FIGS. 19 to 23 show a further exemplary embodiment of the invention. Instead of a positioning means in the form of a screw-on projection, a toothed structure is provided as the positioning means **132*b* on sidewalls of the base element 510 which is provided to accommodate retaining blocks 100, while the retaining blocks 100 preferably have a toothed structure as positioning means 132*a* on both side surfaces 150. When the retaining block 100 is placed on top of the base element 510 from above, teeth of one toothed structure can slide down into spaces between teeth of the other toothed structure and intermesh with each other. The teeth prevent slippage of the retaining blocks 100 on or in the base element 510. By variation of the overlap of the positioning means 132***a*, 132*b* being embodied as toothed structures, a distance between two consecutive retaining blocks 100 can be adjusted to match a length of the items of cutlery 10, 20.

Figure 19:
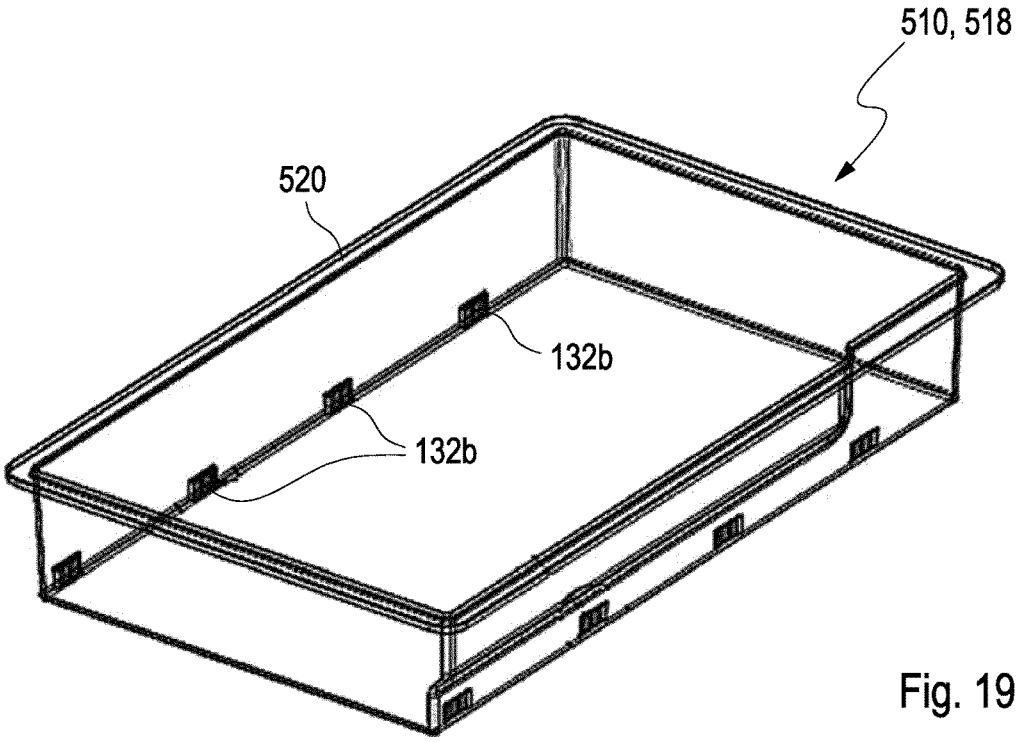
FIG. 19 shows a plan view of a base element of a cutlery-storage system according to a further exemplary embodiment of the invention with peripheral positioning means.

The base element 510 may expediently be designed as a tray 518 with sufficiently high side walls, which can completely accommodate the retaining blocks 100 in height, as shown in FIG. 19. In contrast to the previous Figures, only one component is necessary and not a base element and a separate tray.

Figure 20:
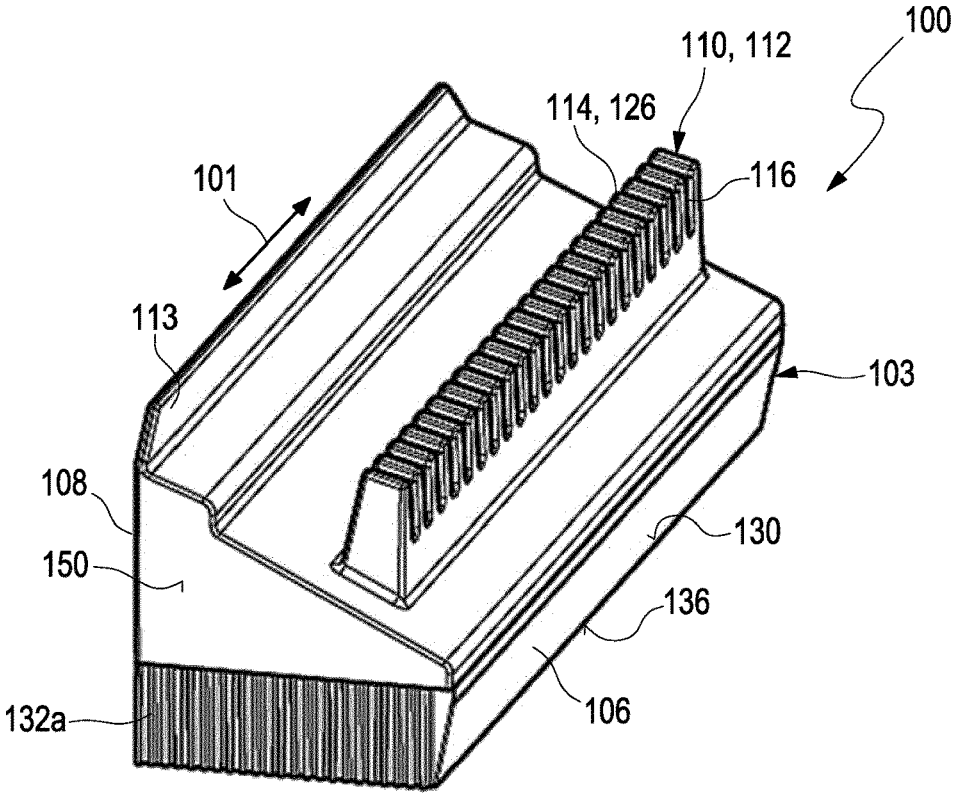
FIG. 20 shows an isometric view of a retaining block according to a further exemplary embodiment of the invention, which can be used for forks and spoons, with peripheral positioning means.

FIG. 20 shows a retaining block 100 for receiving spoons or forks with an appropriate tooth structure as positioning means 132*a*. Moreover, a comb-like structure 110 of the handle-region receiving portion 100 of the retaining block 100 is not arranged starting from the rear side 108 of the base body 103 but is at a distance from it. A closure strip 103 is arranged at the rear side 108. This variant has the overall advantage that items of cutlery with curved handle regions can also easily be inserted into the retaining block 100. The bottom of the comb-like structure 112 may be higher than the top of the handle-region receiving portion 110, which simplifies the removal of items of cutlery, even though the comb-like structure 112 is disposed approximately in the center of the surface of the handle-region receiving portion 110.

The bottom side of the retaining block 100 may be flat and may form the contact surface 136 with the mounting surface 130 on the base element 510.

Figure 21:
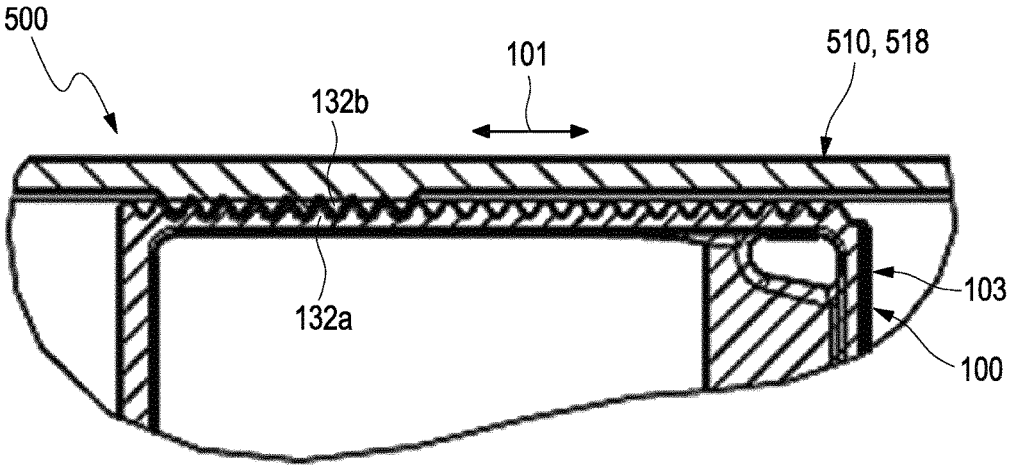
FIG. 21 shows a detail of a connection between a base element and a retaining block with peripheral positioning means.

In a plan view, FIG. 21 shows a detail of a tooth system between the toothed structures of the positioning means 132*a* and 132*b* of the retaining block 100 and of the base element 510 from FIGS. 19 and 20.

Figure 22:
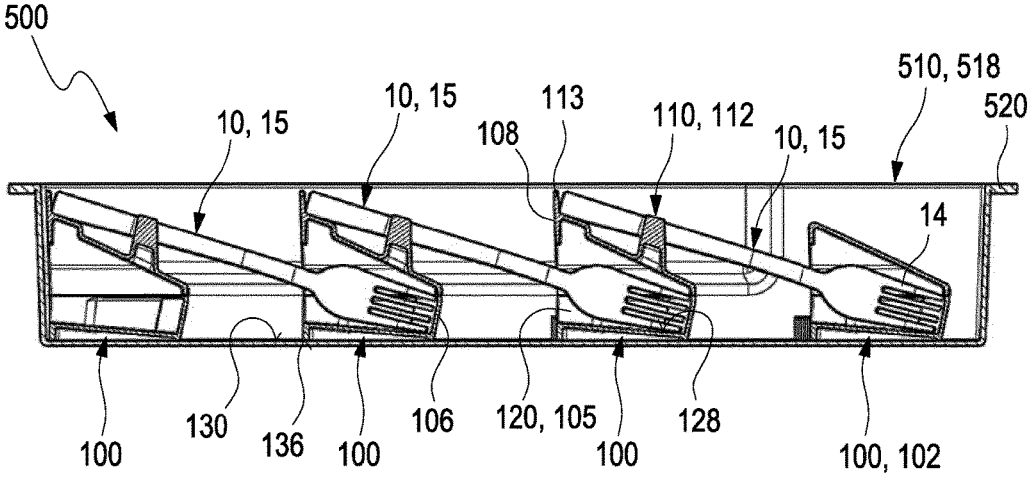
FIG. 22 shows a section through a base element with inserted retaining blocks according to a further exemplary embodiment of the invention with inserted forks in an intended use state.

FIG. 22 shows a section through a cutlery-storage system 500 with forks 15 as items of cutlery 10. Advantageously, the closure strip 113 may be extended downward and thus cover a part of the rear side 108 of the retaining blocks 100. This serves as additional spray protection of the tool-region receiving portion 120 and protects the tool region of unused items of cutlery 10.

Figure 23:
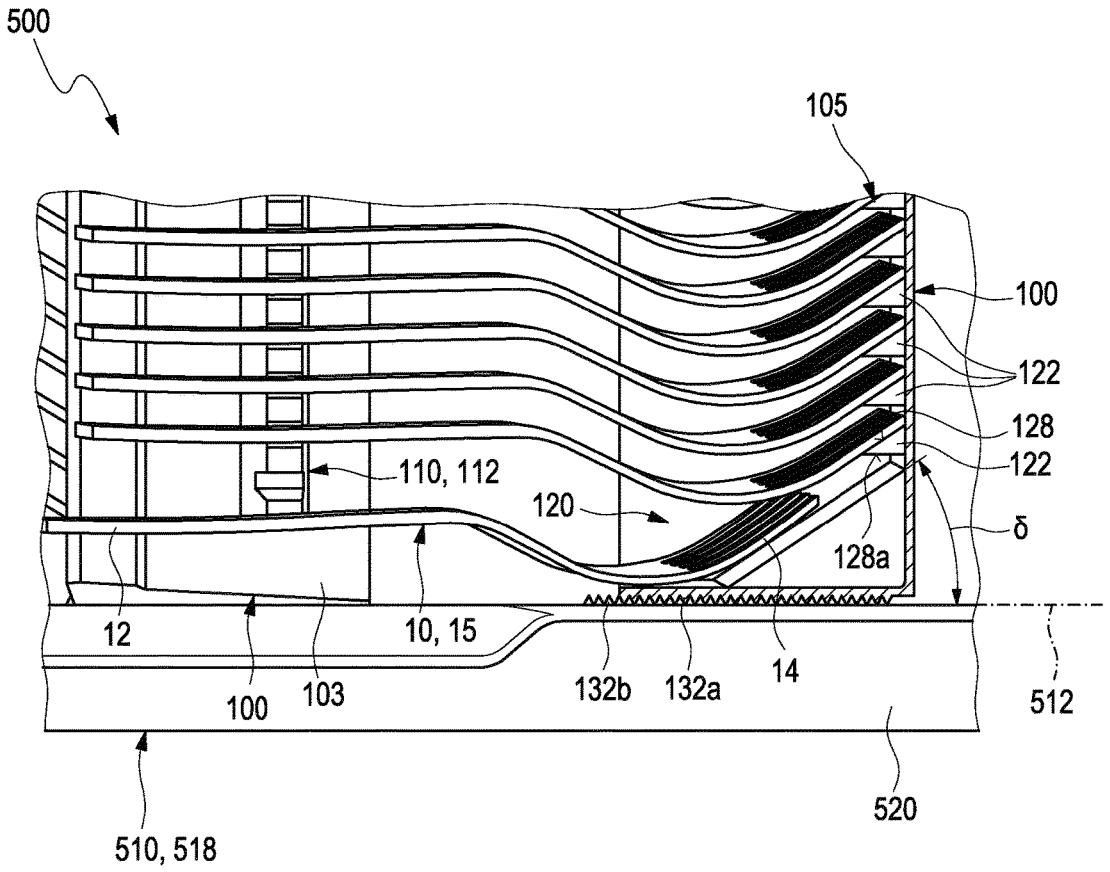
FIG. 23 shows a detail of a plan view of a section through a cutlery-storage system according to a further exemplary embodiment of the invention with inserted forks.

FIG. 23 shows an advantageous embodiment of a comb structure 105 of a tool-region receiving portion 120 of items of cutlery 10, in particular for forks 15.

The comb structure 105 has contact surfaces 128 for the tool region 14 of the items of cutlery 10 as guide surfaces in order to better guide the tool regions 14 of the items of cutlery 10. This facilitates the fast insertion of items of cutlery 10. For this purpose, the comb structure 105 has asymmetrically designed partitions 122 in the form of, in particular, right-angled triangles, with a longer contact surface 128 which serves as a guide surface, and a shorter counter surface 128*a*, which is steeper than the contact surface 128 and, for example, is directed perpendicular to the inner wall of the front part of the tool-region receiving portion 120.

As soon as the tool region 14 of the item of cutlery 10 comes into contact with the contact surface 128 which serves as a guide surface when being inserted into the retaining block 100 of the cutlery-storage system 500, the item of cutlery 10 slides smoothly into its end position in the tool-region receiving portion 120. This is shown by way of example by the lowermost fork 15, which has not yet fully reached its final position.

A favorable angle $\delta$ of the contact surface 128 between the longitudinal axis 512 lies between 7° and 14°, in particular at 10°. Conveniently, the partition 122 protrudes sufficiently far forward that approximately one-third of the length of the tool region 14 of the item of cutlery 10 can rest against the contact surface 128.

The invention claimed is:

1. A retaining block for a cutlery-storage system for one or more items of cutlery, the retaining block having a base body having a height in the direction of a vertical axis, a width in the direction of a transverse axis and a longitudinal extension perpendicular to the vertical axis and the transverse axis, wherein the base body is provided for placement on a mounting surface on a substrate, wherein the base body has a handle-region receiving portion for accommodating a handle region of at least one first item of cutlery and a tool-region receiving portion for accommodating a tool region of at least one other item of cutlery, and the handle-region receiving portion and the tool-region receiving portion are arranged so as to overlap at least partially, wherein the handle-region receiving portion has a comb structure having consecutively alternate partitions and gaps for accommodating the handle regions of a plurality of items of cutlery arranged one after the other along the longitudinal extension, wherein the tool-region receiving portion is configured to accommodate tool regions of items of cutlery in a lateral orientation such that broad sides of the tool regions follow one after the other in the longitudinal extension, wherein, for accommodating items of cutlery in the form of knives, the tool-region receiving portion has slots for receiving blades of the knives, which are laterally limited by contact surfaces of the tool-region receiving portion, wherein the gaps of the handle-region receiving portion facing the tool-region receiving portion are open with slots such that, during insertion, the blades of the knives can be guided below the handle-region receiving portion through the slots of the gap into the slots of the tool-region receiving portion, or wherein, for accommodating items of cutlery in the form of spoons and/or forks, the tool-region receiving portion is concave shaped having a comb structure on a front face for receiving free ends of the tool regions of the items of cutlery, wherein the comb structure has consecutively alternate partitions and gaps for accommodating the free ends in the gaps of the comb structure and the partitions form the contact surfaces.

2. The retaining block according to claim 1, wherein the handle-region receiving portion has an angle of inclination with respect to a mounting surface of the base body such that, in an intended use state, starting from the handle region, an inserted item of cutlery is inclined with respect to the mounting surface by the angle of inclination.

3. The retaining block according to claim 1, wherein the partitions have a tilt angle with respect to a vertical, which is arranged perpendicular to the mounting surface.

4. The retaining block according to claim 1, wherein the tool-region receiving portion exhibits contact surfaces for the tool regions, which contact surfaces have a tilt angle with respect to a vertical, which is arranged perpendicular to the mounting surface.

5. The retaining block according to claim 3, wherein the tool-region receiving portion exhibits contact surfaces for the tool regions, which contact surfaces have a tilt angle with respect to a vertical, which is arranged perpendicular to the mounting surface, and wherein the tilt angles of the partitions and the contact surfaces are identical.

6. The retaining block according to claim 1, wherein a closure strip is provided on the handle-region receiving portion for free ends of the handle regions of the items of cutlery.

7. The retaining block according to claim 1, wherein at least one positioning means is provided to position and/or to fix the base body on a base element in a use state.

8. A cutlery-storage system having a base element for receiving at least two retaining blocks according to claim 1 for one or more items of cutlery, wherein the items of cutlery each have a handle region and a tool region and wherein the handle-region receiving portion is arranged, in the intended use state, above the tool-region receiving portion, wherein a plurality of items of cutlery can be accommodated adjacent to each other along a longitudinal extension of the cutlery, wherein the at least two retaining blocks are arranged on the base element along a longitudinal axis of the base element.

9. The cutlery-storage system according to claim 8, wherein the retaining blocks are lined up on the base element.

10. The cutlery-storage system according to claim 8, wherein the retaining blocks are lined up on the base element along a rail.

11. The cutlery-storage system according to claim 8, wherein a retaining block is provided as a first end piece which is configured without a handle-region receiving portion but having a tool-region receiving portion.

12. The cutlery-storage system according to claim 8, wherein a retaining block is provided as an end piece which is configured without a tool-region receiving portion, but with a handle-region receiving portion.

13. The cutlery-storage system according to claim 8, wherein items of cutlery can be arranged in a single layer on the retaining blocks.

14. The cutlery-storage system according to claim 8, wherein the handle regions of the items of cutlery are arranged cantilevered between the retaining blocks.

15. The cutlery-storage system according to claim 8, wherein at least one of the retaining blocks is illuminated or coupled to a lighting device.

* * * * *